United States Patent [19]

Brusa

[11] Patent Number: 4,764,315

[45] Date of Patent: Aug. 16, 1988

[54] WATER COOLER AND CARBONATOR

[75] Inventor: Paolo E. Brusa, Milan, Italy

[73] Assignee: Ionics, Incorporated, Watertown, Mass.

[21] Appl. No.: 84,353

[22] Filed: Aug. 12, 1987

[51] Int. Cl.[4] ..... B01F 3/04

[52] U.S. Cl. ..... 261/140.1; 261/DIG. 7; 261/123; 261/27

[58] Field of Search ..... 261/DIG. 7, 123, 140.1, 261/27

[56] References Cited

U.S. PATENT DOCUMENTS

| | | | |
|---|---|---|---|
| 659,657 | 10/1900 | Felter | 261/123 |
| 1,605,298 | 11/1926 | Sullivan | 261/123 |
| 2,103,479 | 12/1937 | Magee | 261/43 |
| 2,514,463 | 7/1950 | Bayers, Jr. | 261/140.1 |
| 2,665,559 | 1/1954 | Dexter | 261/140.1 |
| 2,831,013 | 8/1945 | Tanner | 261/140.1 |
| 3,278,271 | 10/1966 | Kono et al. | 261/123 |
| 3,926,342 | 12/1975 | Selvia et al. | 261/140.1 |
| 4,148,334 | 4/1979 | Richards | 261/140.1 |
| 4,514,994 | 5/1984 | Mabb | 222/399 |
| 4,649,809 | 3/1987 | Kanezashi | 222/146.1 |

*Primary Examiner*—Tim Miles

[57] ABSTRACT

A water cooler and carbonator consisting of a water reservoir, apparatus for cooling the reservoir, and a carbonation chamber disposed within the reservoir. Cooled water is transferred to the chamber from the reservoir and a pressure regulated container is used to supply the chamber with carbon dioxide gas, resulting in the production of carbonated water.

2 Claims, 1 Drawing Sheet

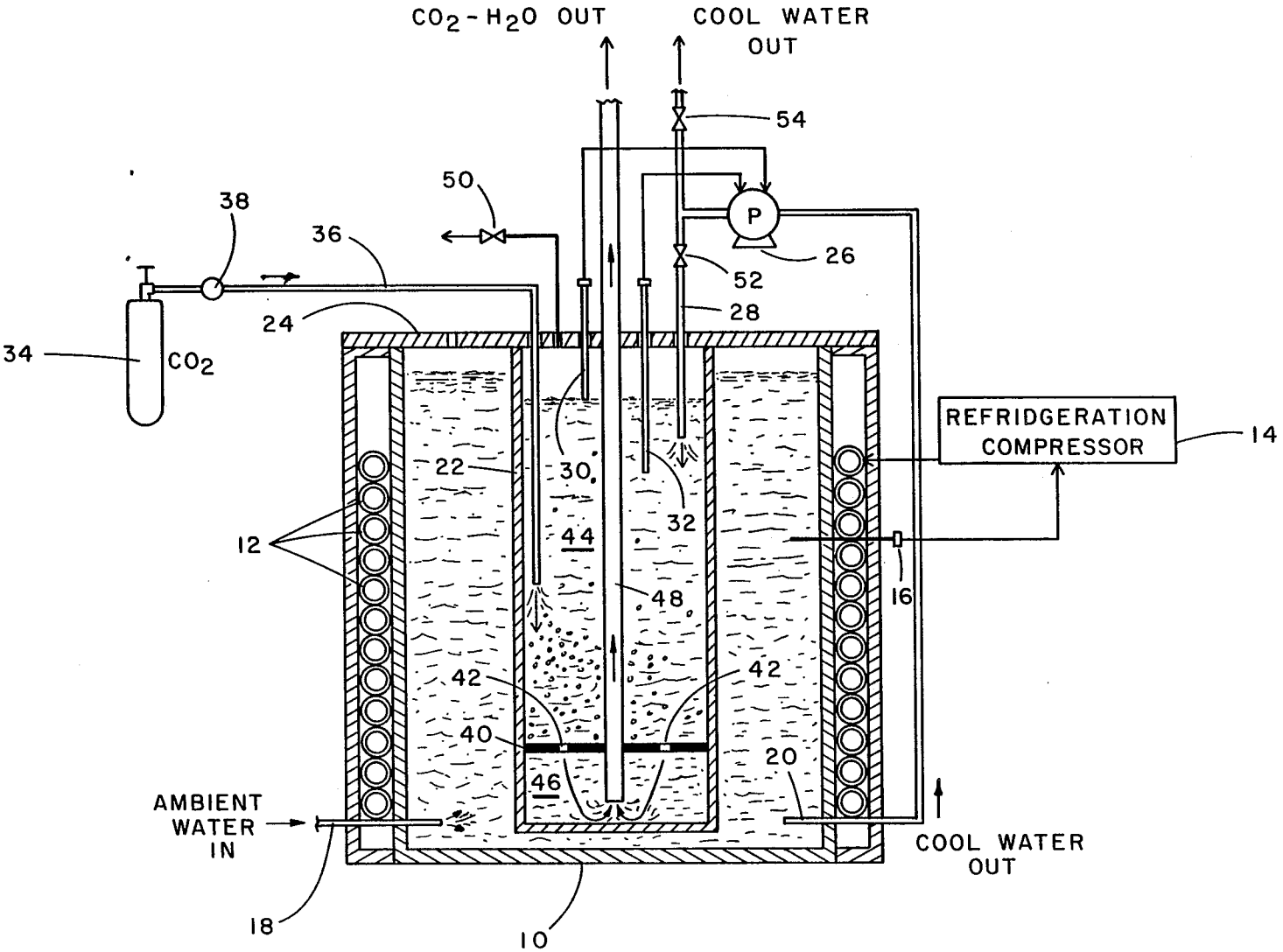
REFRIDGERATION COMPRESSOR
14
16
COOL WATER OUT
COOL WATER OUT
$CO_2$-$H_2O$ OUT
54
26
52
28
P
32
48
30
44
46
42
40
20
22
50
36
24
38
$CO_2$
34
12
AMBIENT WATER IN
18
10

WATER COOLER AND CARBONATOR

BACKGROUND OF THE INVENTION

1. Field of the Invention: The invention resides in the field of water carbonators and more particularly relates to those devices suitable for use in a water cooler for domestic use.

2. Description of the Prior Art: Water carbonation systems for home or restaurant use are known in the prior art. The purpose of these devices is to carbonate cooled water for the preparation of drinks directly at the site of use. Examples are found in U.S. Pat. No. 2,103,479, Magee, showing a refrigerator using a single motor for cooling compression and water delivery; U.S. Pat. No. 4,514,994, Mabb, disclosing a domestic refrigerator having a carbonation system housed therein; and U.S. Pat. No. 4,649,809, Kaneyashi, describing a hot and cold beverage dispensing machine.

There are certain disadvantages to carbonation units installed directly within a refrigerator. These include the amount of volume occupied by the water reservoir and other components reducing food storage capacity, no ability for independent temperature control, internal pressurization and consequential door opening should the system leak, and the exposure of stored food during maintenance operations.

The beverage dispensang machine noted above overcomes these difficulties by providing a self contained unit but is oriented in size and design to commercial utilization. The present invention improves upon the combination of apparatus disclosed in that patent by first transferring water to be carbonated directly from the cold water reservoir to the carbonation chamber and second by providing a unique carbonation chamber having among other features an internal baffle to prevent turbulence in the discharged product.

SUMMARY OF THE INVENTION

The invention may be summarized as a water cooler and carbonator having a water reservoir, apparatus for cooling the reservoir, a carbonation chamber disposed within the reservoir positioned to be immersed in the water contained therein, a pump for transferring water from the reservoir to the chamber, and a container of carbon dioxide gas connected to the chamber for introducing carbonation in the water contained within the chamber.

A pressure regulator controls the amount of gas entering the chamber and thus in conjunction with the temperature of the water, the degree of carbonation. A safety valve may be inserted in the chamber to prevent overpressurization should the regulator fail. Upper and lower water limit switches are optionally contained within the chamber to automatically control the operation of the transfer pump. Additionally, a baffle may be placed in the bottom of the chamber to eliminate foaming and turbulence in the with-drawn product. Appropriate inlet and outlet ports, spigots and check valves are included in the apparatus as required.

These and other features and advantages of the invention will become more evident from the description of the preferred embodiment and drawings which follow.

DESCRIPTION OF THE DRAWING

The drawing is a cross-sectional partially schematic illustration of the preferred embodiment of the invention.

DESCRIPTION OF THE PREFERRED EMBODIMENT

Referring to the drawing, apparatus comprising the preferred embodiment of the water cooler and carbonator is shown in which a cold water reservoir 10 is surrounded by cooling coils 12 operationally connected to refrigerator compressor unit 14 controlled by a temperature control or thermostat 16. Ambient water from a main water supply or bottle container enters the reservoir through pipe 18 and is withdrawn after cooling through pipe 20.

Carbonation chamber 22 is disposed in reservoir 10 secured by plate 24 which extends to form a top lid for the reservoir. Pump 26 operates to transfer cooled water from reservoir 10 to chamber 22 by way of pipe 28 extending through plate 24. High level water sensor 30 and low level water sensor 32 similarly extend through plate 24 into chamber 22 and are operationally connected to pump 26 to control the water level within the chamber.

Container 34 supplies carbon dioxide gas to chamber 22 through pipe 36 which extends through plate 24 and into the chamber below the terminus of low level sensor 32. The portion of the pipe 36 which is located in the carbonation chamber 22 could for example, comprise a venturi spray tube. The pressure of the gas is reduced and controlled by constant regulator 38.

Baffle 40 is positioned near the bottom of chamber 22 and has ports 42 communicating between the upper portion 44 and lower portion 46 of the chamber. Pipe 48 extends from portion 46 through baffle 40 and plate 24 and functions to allow the withdrawal of cooled carbonated water through a suitable spigot not shown.

Pressure to force product water through pipe 48 is provided by the pressurization of chamber 22 from $CO_2$ container 34. Baffle 40 substantially alleviates turbulence within the product by blocking the entrance of large quantities of $CO_2$ gas to lower chamber portion 46 and ensuring that the dissolving and absorption process takes place in upper chamber portion 44. Safety valve 50 communicates with chamber 22 through plate 24 to allow escape of excess gas should pressure valve 38 fail to operate correctly and over-pressurize the chamber.

Uncarbonated cold water may also be withdrawn from the apparatus by employing, for example, valve 52 to block flow to chamber 22 and valve 54 to allow external flow.

Variations in and additions to the above-described system will be obvious to those skilled in the art. For example, provision may be made for the direct withdrawal of ambient temperature water and means for heating water may be included along with appropriate flow controls to create an all purpose beverage machine particularly suited for domestic and office use with bottled water.

Accordingly, the invention described above is hereby defined by the following claims.

What is claimed is:

1. A carbonation chamber for carbonating water disposed therein comprising in combination:

a. a cylindrical tank, said tank having a first inlet at the top for supplying water and a second inlet at the top for supplying carbon dioxide to said tank;

b. a baffle disposed within and at the bottom of said tank, said baffle dividing the tank into upper and lower chambers, said baffle having at least one port allowing the passage of water from the upper to the lower chamber;

c. a first tube for withdrawing carbonated water disposed within said tank extending through said baffle and into said lower chamber and further extending through the top of said tank;

d. a first water level sensor disposed within said tank;

e. a second water level sensor disposed within said tank, said first and second sensors defining upper and lower water levels; and f. a second tube disposed within said tank's upper chamber through said second inlet, said second tube extending to and terminating below said first and second water level sensors for injecting carbon dioxide gas into water disposed in said tank.

2. The apparatus of claim 1 further including gas safety valve means disposed in the top of said tank for limiting the gas pressure within said tank to a selected limit.

* * * * *